US006139482A

United States Patent [19]

Lafleur

[11] Patent Number: 6,139,482

[45] Date of Patent: Oct. 31, 2000

[54] BULK BAG OR LINER AND METHOD OF MAKING IT

[75] Inventor: Lee Lafleur, Manistee, Mich.

[73] Assignee: Custom Packaging Systems, Inc., Manistee, Mich.

[21] Appl. No.: 09/249,396

[22] Filed: Feb. 12, 1999

[51] Int. Cl.[7] ..... B31B 39/00

[52] U.S. Cl. ..... 493/217; 493/210; 493/223; 493/924

[58] Field of Search ..... 493/924, 210, 493/217, 223, 197, 196, 195, 202, 201, 200; 383/107, 120

[56] References Cited

U.S. PATENT DOCUMENTS

| | | | |
|---|---|---|---|
| 3,244,576 | 4/1966 | Swartz | 493/210 |
| 3,266,710 | 8/1966 | Reeves | 493/217 |
| 4,011,798 | 3/1977 | Bambara et al. | 93/35 |
| 4,088,264 | 5/1978 | Vogt | 229/55 |
| 5,104,236 | 4/1992 | LaFleur | 383/17 |
| 5,230,689 | 7/1993 | Derby | 493/210 |

*Primary Examiner*—Stephen F. Gerrity
*Assistant Examiner*—Sam Tawfik
*Attorney, Agent, or Firm*—Reising, Ethington, Barnes, Kisselle, Learman & McCulloch, P.C.

[57] ABSTRACT

A method of making flexible and collapsible bulk bags or liners for bulk bags or containers from individual flat panels of material, or tubes of material folded flat, is disclosed. The bags or liners have one or more sidewalls interconnected by at least a bottom wall and preferably also a top wall generally opposed to the bottom wall. The bags are preferably formed by disposing a pair of inner blanks of material with one on top of the other and then heat sealing along a straight line generally bisecting the blanks and thereafter severing the heat seal along its entire length. Next, a pair of outer blanks of material are disposed adjacent the inner blanks with the inner blanks received between the outer blanks. The outer blanks are each heat sealed about their side edges to an adjacent side edge of an inner blank. Once so formed, the inner blanks form a pair of gusseted panels received between the outer and overlying panels. When expanded, this configuration provides four generally rectilinear sidewalls of the bulk bag. To form the bottom wall of the bulk bag, the outer blanks are heat sealed to the adjacent gusseted, inner blanks along canted lines forming a triangular portion integral with each sidewall. When heat sealed in this manner, a generally rectangular bottom wall, integral with the sidewalls, is formed. A top wall may be formed in a similar manner or separately attached to the bag.

27 Claims, 6 Drawing Sheets

BULK BAG OR LINER AND METHOD OF MAKING IT

FIELD OF THE INVENTION

This invention relates generally to bulk containers and more specifically to collapsible bulk containers made of a flexible material and a method of making them.

BACKGROUND OF THE INVENTION

Some bulk containers are made of a flexible plastic material such that they may be collapsed and folded when empty to facilitate storing and shipping them. These bulk containers may typically contain a ton or more of material and may be formed as a bag of a woven fabric material or, if a waterproof container is desired, the bag or a complementary liner may be formed from a plastic sheet such as a polyethylene or polypropylene film typically having a thickness between 4 to 10 mils. Previous such bulk containers, such as disclosed in U.S. Pat. No. 5,104,236 have been formed from a tubular blank of material and may be formed without any scrap and are very useful, durable and reliable in use.

However, certain materials are not available in tubular form and cannot easily be formed into a tubular blank without damaging the material. Examples of such materials are metallized materials such as various metallic foils, nylon, Ethylene-vinyl-alcohol (EVOH), or a metallized saran or polyvinylidene chloride or vinylidene copolymer film commonly sold under the trade name Saranex®, from the Dow Chemical Company. The metallized saran or other foils or films can be weak and if placed over a folding board or the like to form a tubular blank, the board may crease and damage the metal foil or film. Typically, to provide reinforcement for such materials, they are coextruded with a polyethylene or polypropylene film as the outer layer and the saran or other material as the inner layer to provide a liquid-tight barrier layer. Thus, to maintain the integrity of the bag or liner it is imperative that the inner, barrier layer not be damaged, breached or broken during manufacture and assembly of the bag.

SUMMARY OF THE INVENTION

A method of making flexible and collapsible bulk bags or liners for bulk bags or containers from individual flat panels of material or tubes of material folded flat is disclosed. The bags have one or more sidewalls interconnected by at least a bottom wall and preferably also a top wall generally opposed to the bottom wall. The bags are preferably formed by disposing a pair of flat inner blanks of material with one on top of the other and then heat sealing along a straight line generally bisecting the blanks and thereafter severing the heat seal along its entire length. Next, a pair of flat outer blanks of material are disposed adjacent the inner blanks with the inner blanks received between the outer blanks. The outer blanks are each heat sealed about their side edges to an adjacent side edge of an inner blank. Once so formed, the inner blanks form a pair of gusseted panels received between the outer and overlying panels. When expanded, this configuration provides four generally rectilinear sidewalls of the bulk bag. To form the bottom wall of the bulk bag, the outer blanks are heat sealed to the adjacent gusseted, inner blanks along canted lines forming a triangular portion integral with each sidewall. When heat sealed in this manner, a generally rectangular bottom wall, integral with the sidewalls, is formed.

A top wall may be formed in a similar manner by heat sealing along canted lines adjacent the upper edge of the sidewalls, or if desired, a separate top may be attached to the upper edge of the sidewalls. Advantageously, such a bag or liner may be made from tubular blanks of material or from flat panels of material without having to bend or fold the flat panels of material. Further, bags or liners can be formed having multiple layers of material without having to "stuff" or insert a bag into another bag or bags.

By forming the bulk bag from individual flat panels of material without having to fold the panels, metallic foils, saran and other materials which may be damaged if bent or folded may be used without damaging or compromising these materials as the bag or liner is made. Desirably, such materials may provide the leakproof inner, barrier layer of a bag or liner formed from coextruded materials or multiple layers of different materials. Thus, bags can be formed with an effective inner barrier layer and outer reinforcing layers and may be easily and economically formed into a bulk bag from flat panels without damaging the materials.

As indicated above, multi-layer bags may also be formed by a similar method using tubular blanks of material as opposed to flat sheets. Desirably, such bags have integrally formed multi-layer walls to avoid the numerous problems associated with stuffing one bag or tubular blank into another to form a multi-layer bag or liner.

Objects, features and advantages of this invention include providing a gusseted, collapsible bulk bag or liner that may be formed from individual flat panels of material without having to fold the panels of materials which may provide a liquid-tight enclosure, may be formed from woven fabric materials or plastic films, may be formed with an integral top and bottom wall, may be formed with a coextruded polyethylene and saran material, may be formed with walls having multiple layers of material, may be easily formed from tubular blanks of material to provide a multi-layer bag or liner without having to stuff or insert a bag or liner into another bag or liner, can be formed of multiple layers of different materials, can be more accurately formed with multiple layers of material, can be square or rectangular in cross-section, and is reliable, durable, of relatively simple design and economical manufacture and assembly and has a long useful life in service.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENTS

Referring in more detail to the drawings, FIGS. 1–11 illustrate a bulk bag 10 or a liner for a bulk container and a method of making the bulk bag 10 from elongate, generally rectangular, flat sheets or panels of material without having to fold the panels. To make a bag 10 having great strength and capable of containing a ton or more of material, the panels may be of a woven polyethylene or polypropylene fabric. To provide a leak-proof bag 10, the panels may be of a polyethylene or polypropylene film or may be one or more coextruded films, such as material having an outer layer of polyethylene or polypropylene and a metallized saran inner layer. Such a coextruded saran film is commercially available and sold under the name Saranex® by Dow Chemical Company. Other materials available as flat sheets may also be used such as metal foils, nylon and ethylene vinyl alcohol, to name a few.

Figure 4:
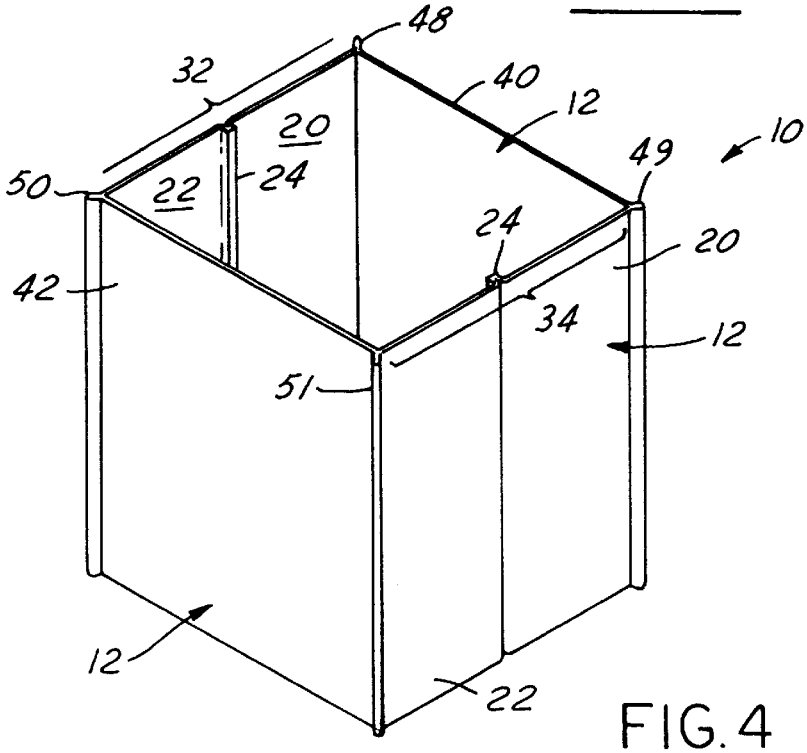
FIG. 4 is a perspective view illustrating the generally cubical configuration of the panels when connected as shown in FIG. 3 and expanded.
Figure 11:
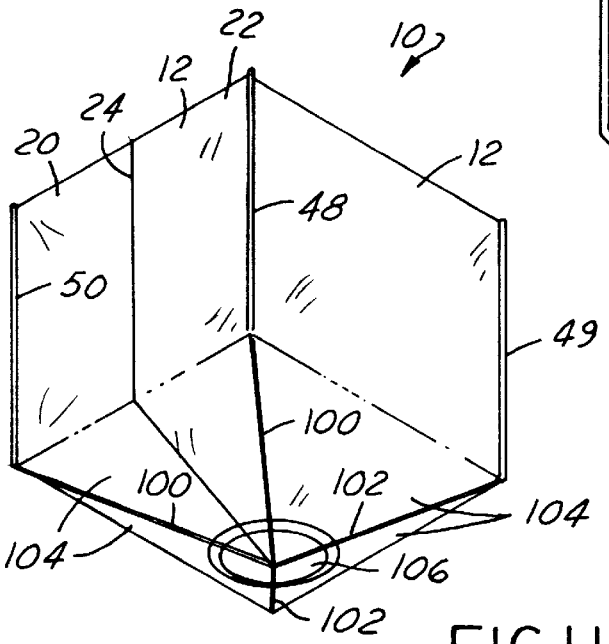
FIG. 11 is a perspective view illustrating the end wall formed in FIG. 10 and the reinforcing patch.
Figure 14:
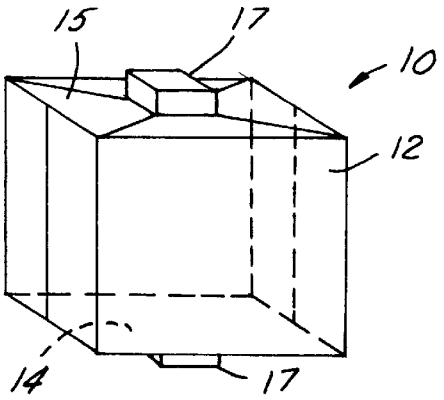
FIG. 14 is a perspective view of a collapsible bulk bag with a spout provided in each of its top and bottom walls.

When formed and expanded, as shown in FIGS. 4 and 11, the bags 10 preferably have a generally cubical configuration with four rectilinear sidewalls 12 and at least a bottom wall 14 interconnecting the lower edge of the sidewalls 12 and may also be formed with an integral top wall 15 (FIG. 14) interconnecting the upper edge of each sidewall 12. Additionally, a spout 17 (FIG. 14) may be provided in one or both of the top and bottom walls to facilitate filling and emptying the liner or bag 10. Spouts may also be provided extending through a sidewall, if desired. The spouts may be integrally formed with the liners or bags 10 or, they may be separately attached such as by heat sealing a peripheral flange of the spout to the liners or bags 10. A collapsible and foldable gusseted bag and liner bag, formed from an elongate tubular blank of material, is disclosed in U.S. Pat. No. 5,104,236, the disclosure of which is incorporated herein by reference in its entirety.

Figure 1:
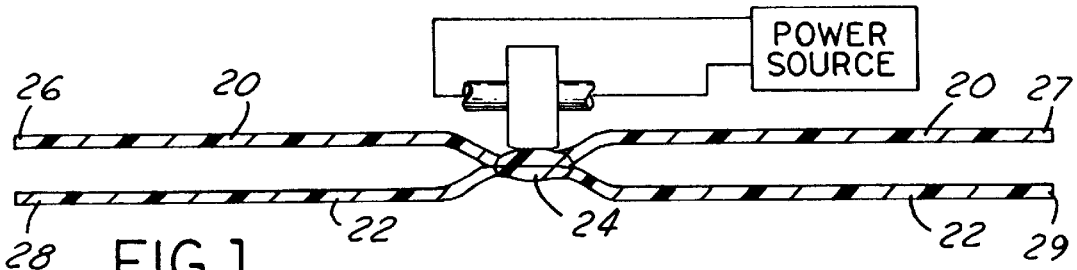
FIG. 1 is a sectional view illustrating a pair of inner flat panels being heat sealed together as a first step in forming a bulk bag according to the present invention.
Figure 2:
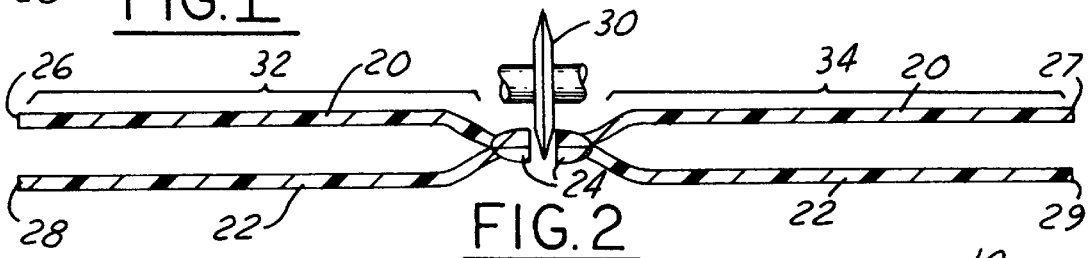
FIG. 2 is a cross sectional view illustrating the heat seal formed in FIG. 1 being severed by a cutter.

As shown in FIG. 1, a first step in forming the bulk bag 10 from the plurality of elongate, flat panels is to dispose a pair of inner flat panels 20, 22 one on top of the other, and then heat seal the inner flat panels 20, 22 together along a line 24 generally midway between the side edges 26, 27 of panel 20 and the side edges 28, 29 of panel 22 or generally along the longitudinal axis of the inner flat panels 20, 22. Next, as shown in FIG. 2, a blade 30 is used to cut through and bisect the heat seal line 24 and separate a left half 32 of the inner flat panels 20, 22 from a right half 34 of the inner flat panels 20, 22. The heat seal must be made sufficiently wide such that when severed by the blade 30, a sufficient heat seal exists at the juncture between the inner flat panels 20, 22 of both the left half 32 and the right half 34 of the severed inner flat panels 20, 22. If desired, a pair of spaced apart parallel heat seals may be formed instead of a single, wider heat seal, and then the blade may be used to sever the inner flat panels 20, 22 between the pair of heat seals.

Figure 3:
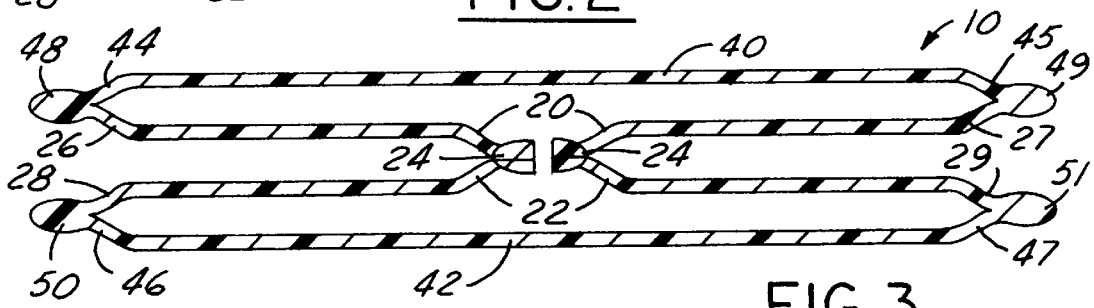
FIG. 3 is a cross sectional view illustrating a pair of outer flat panels heat sealed to the inner flat panels of FIG. 2.

As shown in FIG. 3, a pair of outer flat panels 40, 42 are disposed adjacent opposed sides of the left and right halves 32, 34 of the inner flat panels 20, 22 so that the severed inner flat panels 20, 22 are received between the outer flat panels 40, 42. The side edges 44 & 45 and 46 & 47 of each outer panel 40, 42, respectively, are then heat sealed to an adjacent side edge 26 & 27 or 28 & 29 of each inner flat panel 20, 22, as shown in FIG. 3, along the entire length of the side edges of both the inner flat panels 20, 22 and the outer flat panels 40, 42. Specifically, the side edges 44, 45 of outer panel 40 are heat sealed to the side edges 26, 27 of inner panel 20 along lines 48 and 49. The side edges 46, 47 of outer panel 42 are heat sealed to the side edges 28, 29 of inner panel 22 along lines 50, 51. Joining the flat panels 20, 22 and 40, 42 as described thus far, provides four generally rectangular sidewalls 12 of the bag 10 when expanded, as shown in FIG. 4 with two opposed walls being gusseted by the heat seals 24 so that when empty the bag can be collapsed and folded flat without creasing or folding over the panels.

Figure 5:
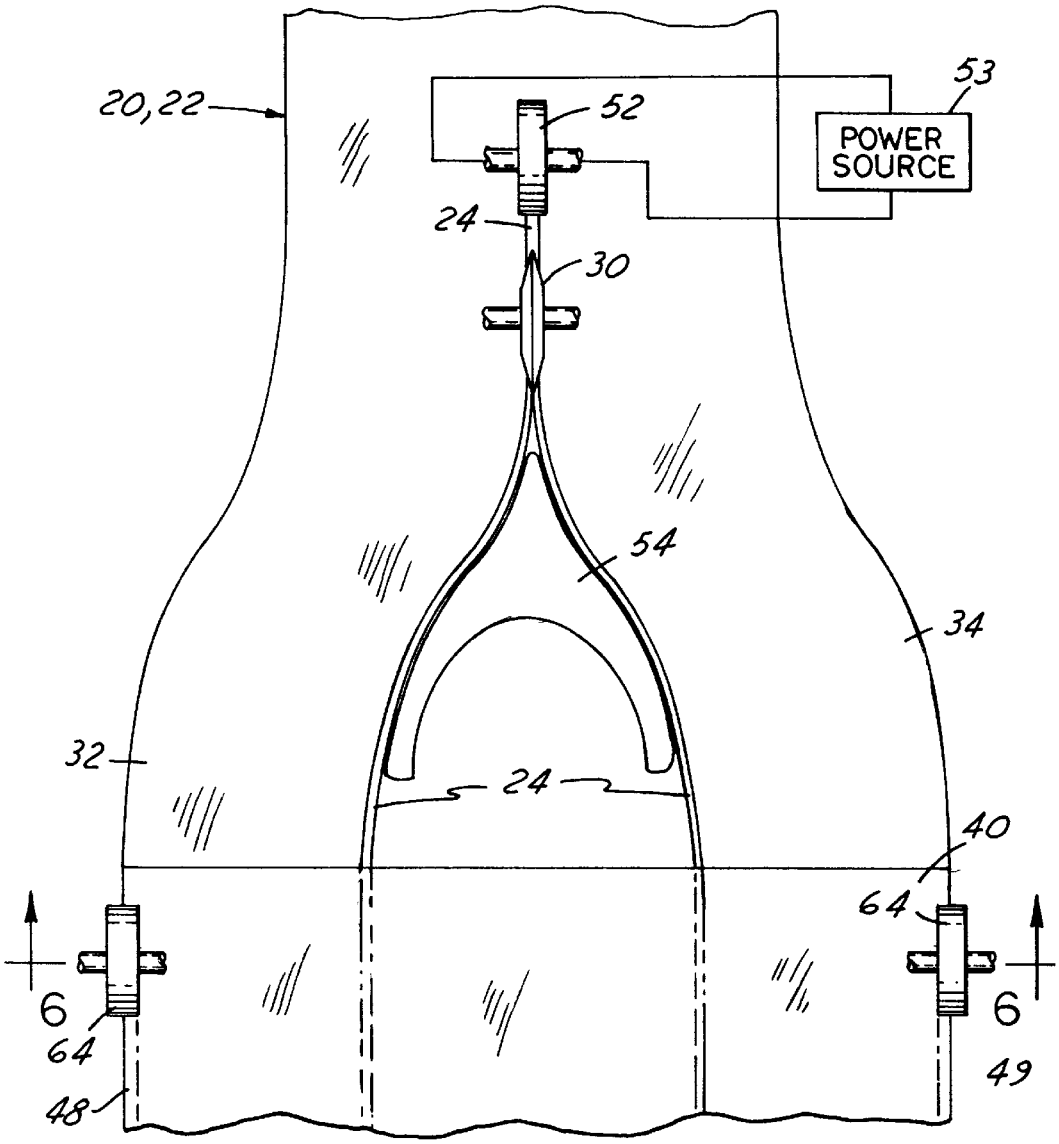
FIG. 5 is a side view illustrating a plurality of collapsible bulk bags being formed from elongate panels of material.

As previously illustrated and described with reference to FIGS. 1–4, the bags 10 may be formed from discrete lengths of the flat panels 20, 22 and 40, 42 or, as shown in FIGS. 5–8, the bags 10 may be formed from individual elongate and continuous flat panels pulled directly from wound rolls of the flat panels and then formed in the same general manner and same general configuration as the individual bags 10 of FIGS. 1–4. As shown in FIG. 5, a pair of generally continuous and elongate inner flat panels 20, 22 are heat sealed along their longitudinal axis as each inner flat panel 20, 22 is drawn or pulled off of a wound roll and moved in the downward or outward direction as viewed in FIG. 5. When so moved, the inner flat panels 20, 22 are heat sealed along their longitudinal axis on line 24 by a stationary heat sealer 52 powered by an external electric power source 53. Downstream of the heat sealer 52 is a stationary blade 30 which severs the inner flat panels 20, 22 along the heat seal line 24 to provide a configuration which in cross section is the same as shown in FIG. 2. A wedge 54 may be disposed downstream of the blade 30 to separate the left and right halves 32, 34 of the inner flat panels 20, 22 to facilitate forming a bag which is generally rectangular in cross section as opposed to generally square in cross section as shown in FIG. 4. Angled or inclined rollers may also be used to separate the cut halves 32, 34 of the material without the wrinkling or bunching up of the material which may occur with the wedge 54. To form a bag which is generally square in cross section, the wedge or rollers would not be used and the left and right halves 32, 34 of the inner flat panels 20, 22 would be left generally immediately adjacent to each other.

Figure 6:
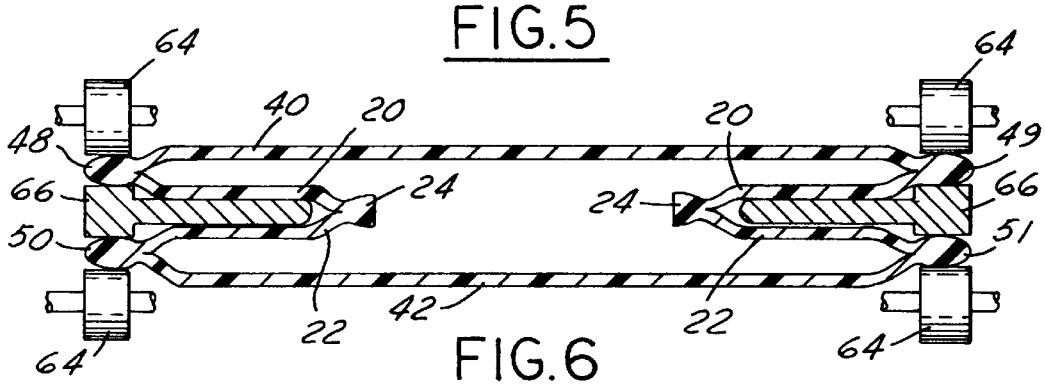
FIG. 6 is a cross sectional view taken along line 6—6 of FIG. 5.
Figure 7:
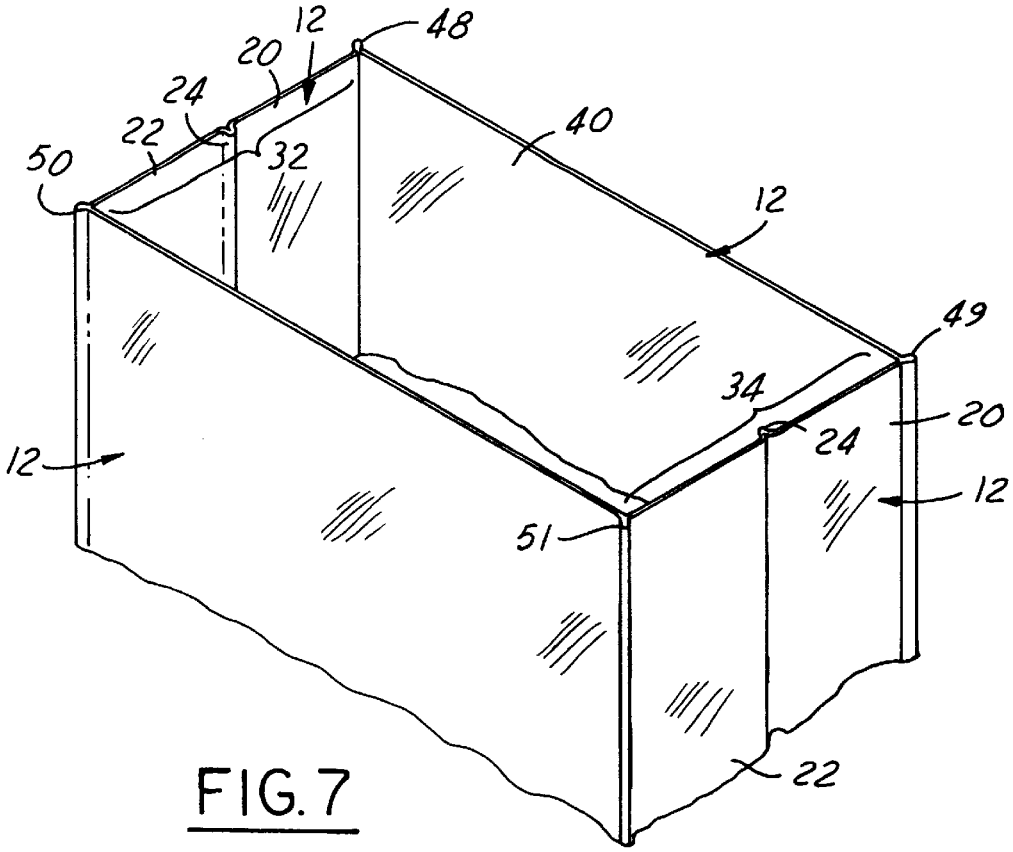
FIG. 7 is a partial perspective view illustrating a collapsible bulk bag formed with a rectangular cross section.

At a location downstream of the wedge 54 or rollers, the outer flat panels 40, 42 are disposed over opposed sides of the left and right halves 32, 34 of the inner flat panels 20, 22 and are preferably pulled off of wound rolls 60, 62 (FIG. 8) of material and moved in the same direction as the inner flat panels 20, 22. When so removed from the wound rolls 60, 62, the outer flat panels 40, 42 and severed inner flat panels 20, 22 are moved between spaced apart heat sealers 64 which heat seal the side edges 44–47 of the outer flat panels 40, 42 to the side edges 26–29 of the inner flat panels 20, 22 as shown in FIG. 6. To prevent the adjacent inner flat panels 20, 22 from being heat sealed together, spacers 66 having low thermal conductivity, such as Teflon plates, are disposed within the left and right halves 32, 34 of the severed inner flat panels 20, 22 and between the sealers 64 as the heat seals are formed. As shown in FIGS. 6 and 7, the outer flat panels 40, 42 have a greater width than the left and right halves 32, 34 of the inner flat panels 20, 22 and when expanded, the bag 10 is generally rectangular in cross section.

Figure 8:
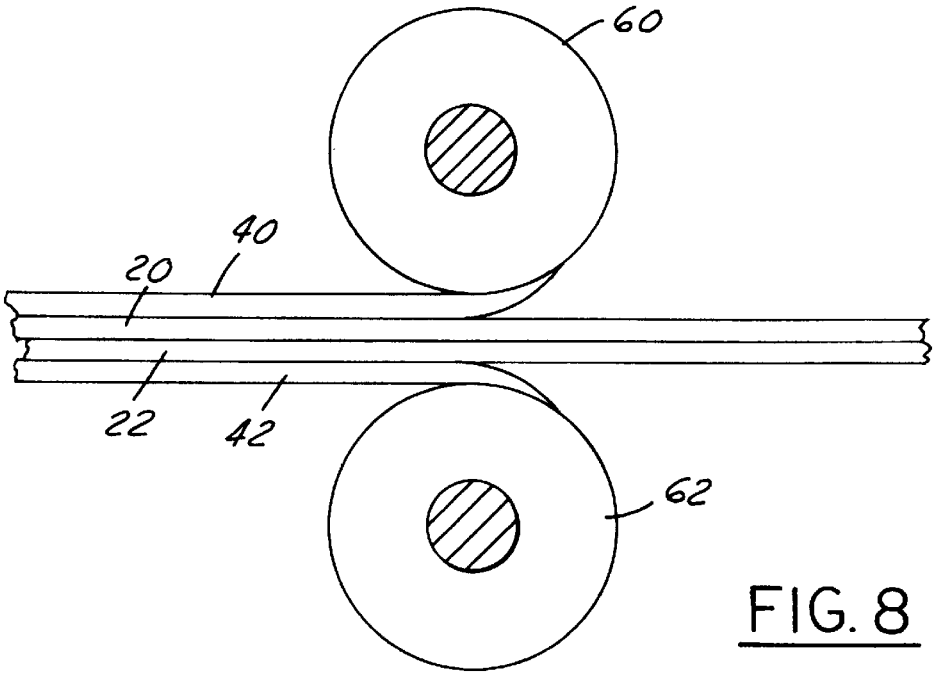
FIG. 8 is a diagrammatic view showing a pair of wound rolls of material adapted to apply the pair of outer flat panels to the inner flat panels after the inner flat panels have been heat sealed and then severed along that heat seal.

FIG. 8 illustrates the addition of the outer flat panels 40, 42 to the inner flat panels 20, 22, after the inner flat panels are heat sealed together and severed, by disposing the wound rolls 60, 62 of material of the outer flat panels 40, 42 adjacent to the inner flat panels 20, 22 and then drawing each of the panels 20, 22 and 40, 42 at generally the same rate through the downstream heat sealers 64 to form the sidewall 12 of the bag 10.

Figure 9:
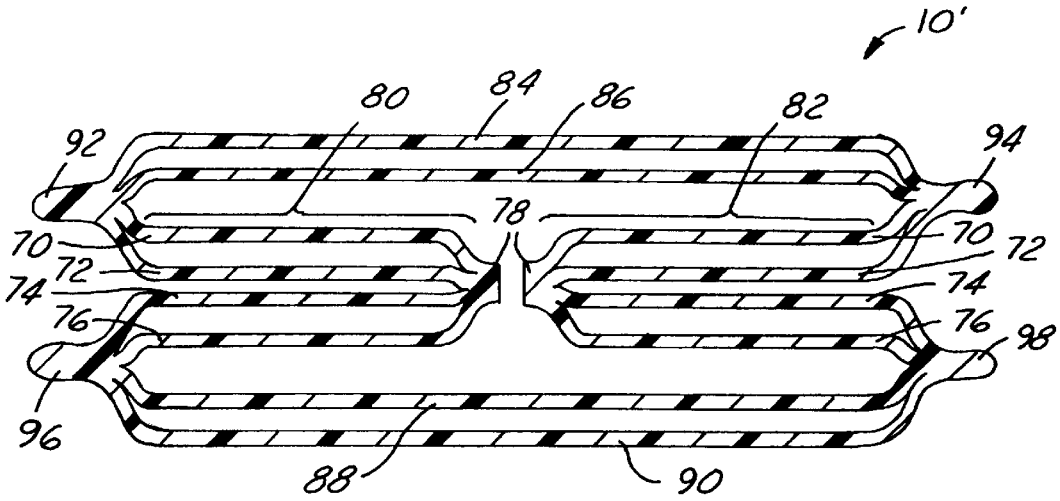
FIG. 9 is a cross sectional view illustrating a collapsible bulk bag wherein each wall is formed from two layers of material.

FIG. 9 illustrates a bag 10' having each wall formed from two layers or panels of material. To form such a bag 10', four inner flat panels 70, 72, 74, 76 are provided and sealed together by a heat seal 78 extending generally along their longitudinal axis. The heat seal 78 is then severed and bisected providing left and right halves 80, 82 of the inner flat panels 70–76 and four outer flat panels 84, 86, 88, 90 are disposed in pairs adjacent opposed sides of the severed inner flat panels 70–76 and are heat sealed to the adjacent layers of material of the inner flat panels 70–76 along the side edges of the outer flat panels 84–90 and inner flat panels 70–76.

Figure 12:
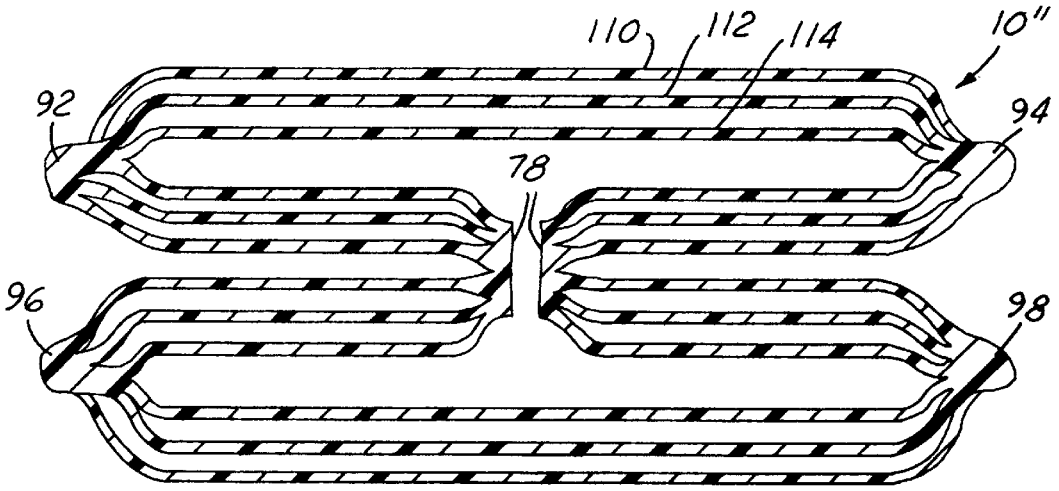
FIG. 12 is a cross sectional view illustrating a collapsible bulk bag wherein each wall is formed of three layers of material.
Figure 13:
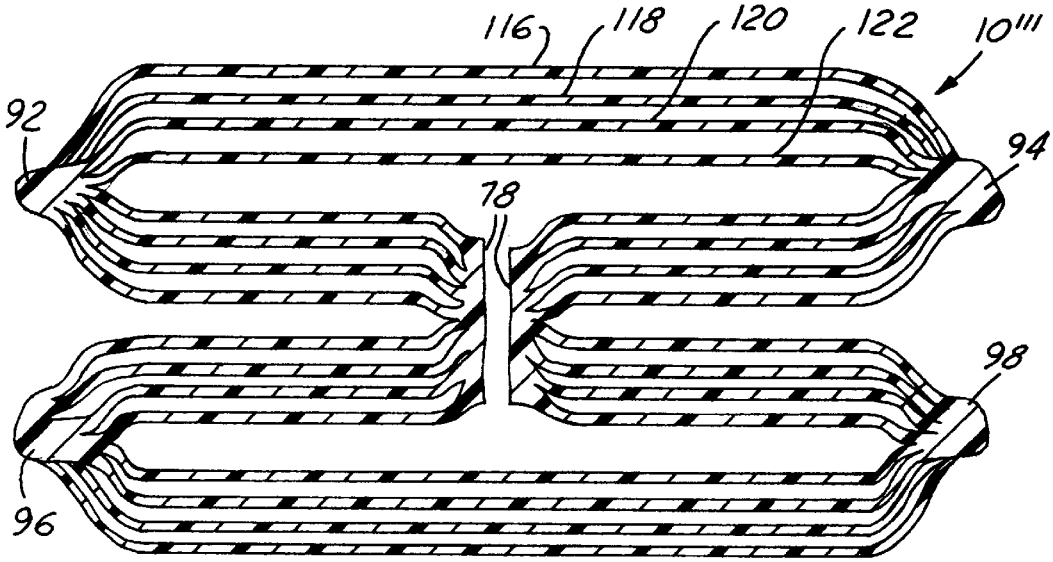
FIG. 13 is a cross sectional view illustrating a collapsible bulk bag wherein each wall is formed of four layers of material.

Specifically, as shown in FIG. 9, the side edges of outer panels 84 and 86 are heat sealed to the side edges of inner panels 70 and 72 along lines 92 and 94. The side edges of outer panels 88 and 90 are heat sealed to the side edges of inner panels 74 and 76 along lines 96 and 98. Thus, when expanded, each wall of the bag 10' will have a double layer of material to increase the strength of the bag 10'. Similarly, as shown in FIG. 12, a bag or liner 10" may be formed having three layers of material 110, 112 and 114 and, as shown in FIG. 13, a liner 10''' may be formed having four layers of material 116, 118, 120 and 122. Although bags may be formed from more than four layers of material, with more than four layers of material it is difficult to ensure a sufficient simultaneous heat seal of all layers. Advantageously, multi-layer bags or liners may be formed without stuffing a bag into another bag which results in wrinkling, misalignment or damaging the material of the liners or bags. Also, because the gusset panels of each layer are formed by the same heat seal line, the multi-layer bags are accurately formed with each layer in perfect alignment. The various layers of a multi-layer bag may be formed of different materials, as desired, as long as the materials can be heat sealed to each other.

Figure 10:
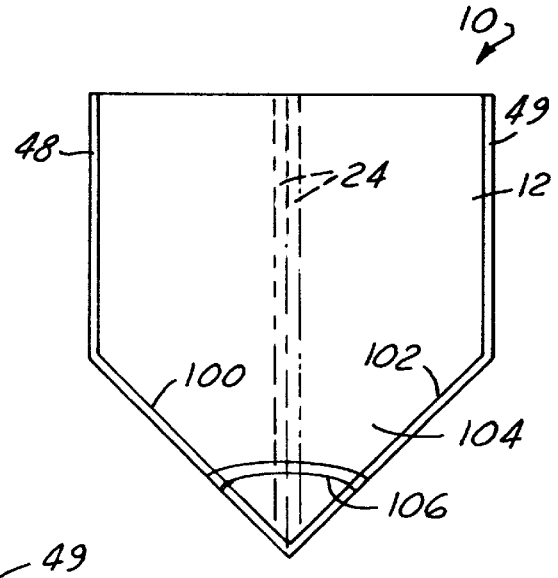
FIG. 10 is a side view illustrating the collapsible bulk bag heat sealed along canted lines to form a bottom wall of the bag and having a reinforcing patch heat sealed to the bottom wall overlapping the connection between adjacent panels.

As shown in FIGS. 10 and 11, a bottom wall 14 of the bag 10 may be formed by heat sealing the outer panels 40, 42 to the adjacent inner panels 20, 22 along canted lines 100, 102 which, when folded as shown in FIGS. 3 & 10, form triangular portions 104 adjacent the lower edge of each sidewall 12. As described earlier, to prevent the inner flat panels 20, 22 from being heat sealed together, spacers 66 of low thermal conductivity may be disposed between the flat panels as the canted heat seals along lines 100, 102 are formed. When heat sealed along these canted lines 100, 102 and expanded, as shown in FIG. 11, it can be seen that adjacent sides of adjacent triangular portions 104 are connected providing a generally rectangular bottom wall 14 of the bag 10. Especially when providing a bottom wall 14 for a bag 10', 10" or 10''' having multiple layers of material, such as that shown in FIGS. 9, 12 or 13 a circular reinforcing patch 106 may be provided adjacent the juncture of the apexes of each triangular portion 104 wherein a large number of layers of material or panels are heat sealed together to increase the load bearing capacity of the bag 10, 10', 10" or 10''' and/or to prevent leaks at the convergence of the heat seal which may not completely heat seal each and every of the plurality of panels together.

Figure 15:
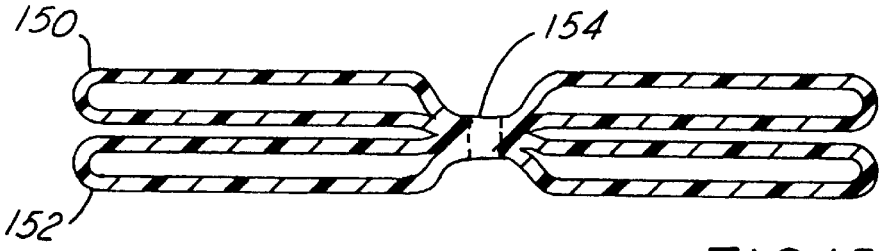
FIG. 15 is a sectional view illustrating a pair of tubular blanks being heat sealed together as a first step in forming a bulk bag according to the present invention having walls formed from two layers of material.
Figure 16:
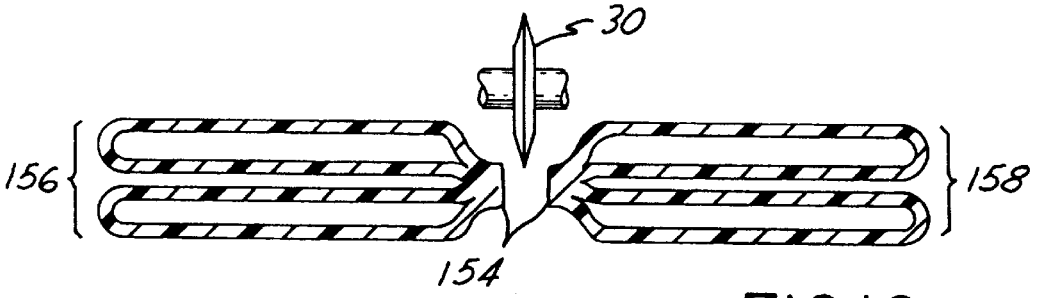
FIG. 16 is a sectional view illustrating the heat seal formed in FIG. 15 being severed.
Figure 17:
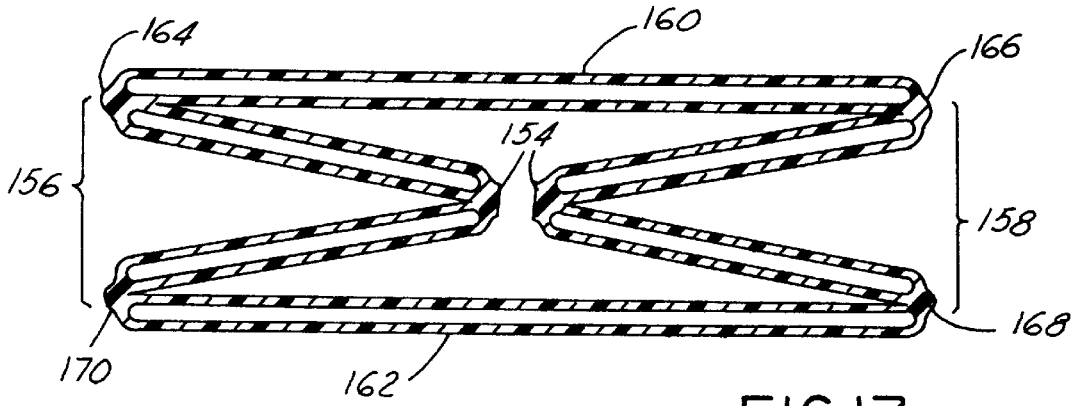
FIG. 17 is a sectional view illustrating a pair of outer tubular blanks heat sealed to the inner blanks of FIG. 16.

As shown in FIGS. 15–17, multi-layer bags or liners may also be formed from tubular blanks of material. Because the tubular blanks are folded flat during manufacture of the bags or liners, materials which may be folded without damaging them should be used.

Referring to FIG. 15, two tubular blanks 150, 152 are shown folded generally flat and heat sealed together along heat seal line 154. Next, as shown in FIG. 16, a cut is provided through heat seal line 154 providing right and left halves 156, 158 each defining a gusset panel when the bag or liner is completed. An additional pair of tubular blanks 160, 162 are disposed on opposed upper and lower sides of the right and left halves 156, 158, as shown in FIG. 17, and are heat sealed to an adjacent edge of the right and left halves 156, 158 along heat seal lines 164, 166, 168 and 170. Thus, tubular blanks 160, 162 provide overlying flat panels with the gusset panels (formed by the right and left halves 156, 158) received between them to define four sidewalls each formed from two layers of material. Bags or liners with more than two layers of material may also be formed from tubular blanks in a similar manner. Desirably, such multi-layer bags or liners are formed without having to stuff tubular blanks of material or formed bags into one another. Further, these multi-layer bags are accurately formed without misalignment or the wrinkling or bunching up of layers which occurs when two bags of substantially the same size are mated to provide a multi-layer bag.

Some bag materials are available in elongate, seamless, tubular webs and may be formed as disclosed in U.S. Pat. No. 5,104,236. However, many materials are available only in flat sheets or panels and at least some materials, such as metallized saran, are not easily folded in production and when disposed around a folding board, the board may damage the metal film and thereby destroy the barrier provided by that film. Thus, a coextruded material having, for example, a polyethylene or polypropylene outer layer and a saran, foil or other inner layer may be conveniently formed into a bulk bag or liner 10 according to the method of the present invention. The polyethylene or polypropylene provides a strong, durable bag 10 and also facilitates heat sealing of the bag 10, while the inner layer provides an effective barrier for a leak-proof bag or liner 10. Thus, the invention provides a relatively simple method to form a plurality of bulk bags or liners 10 from elongate flat panels of material which can be accomplished without having to fold any of the panels, can be substantially automated, and hence has a high rate of production of bags 10 and a relatively low cost. The invention also provides an accurate and simple way to form multi-layer bags or liners from tubular blanks of material.

What is claimed is:

1. A method of making a flexible and collapsible bulk bag from a plurality of generally flat blanks comprising the steps of:

a) providing at least a pair of generally flat inner blanks each having at least one pair of opposed side edges and connecting them together along a line generally midway between the pair of opposed side edges of each inner blank;

b) severing each inner blank along the line of connection forming a left half and a right half of gusseted inner blanks with each half comprising a portion of each of the inner blanks with the portions of each inner blank of each half still connected together;

c) providing at least a pair of generally flat outer blanks adjacent the left and right halves of the severed inner blanks with the left and right halves received between the outer blanks, the outer blanks each have a pair of opposed side edges generally aligned with the side edges of the inner blanks;

d) connecting together the side edges of the outer blanks with the adjacent side edges of the gusseted inner blanks so that the inner blanks define opposed side walls of the bag; and e) providing a bottom wall interconnecting one end of each of the outer blanks and the left and right halves of the gusseted inner blanks.

2. The method of claim 1 wherein the line of connection between the inner blanks is formed by heat sealing the inner blanks together.

3. The method of claim 1 wherein step a) also comprises providing a second line of connection between the inner blanks, spaced from and adjacent the other line of connection and extending generally parallel to the other line of connection.

4. The method of claim 3 wherein step b) comprises severing the inner blanks between the second line of connection and the other line of connection.

5. The method of claim 1 wherein in step a) said inner blanks comprise four flat panels and in step c) said outer blanks comprise four flat panels with the severed inner blanks received between opposed pairs of outer blanks to provide a bag with each sidewall formed from two layers of material.

6. The method of claim 1 wherein in step a) the inner blanks comprise six flat panels and in step c) the outer blanks comprise six flat panels with the severed inner blanks received between opposed sets of three layers of outer blanks to provide a bag with each sidewall formed from three layers of material.

7. The method of claim 1 wherein in step a) the inner blanks comprise eight flat panels and in step c) the outer blanks comprise eight flat panels with the severed inner blanks received between opposed sets of four layers of outer blanks to provide a bag with each sidewall formed from four layers of material.

8. The method of claim 1 wherein each line of connection between the outer blanks and inner blanks is formed by heat sealing.

9. The method of claim 1 wherein step e) comprises connecting each outer blank to an adjacent inner blank along canted lines forming triangular portions adjacent an end of each outer blank and an adjacent end of both the left and right halves of the severed inner blanks to provide a generally rectilinear, integral bottom wall when the bag is expanded.

10. The method of claim 1 wherein the outer blanks have a greater width than the left and right halves of the severed inner blanks when expanded, so that the bag is generally rectangular in cross section when expanded.

11. The method of claim 1 wherein each inner blank and each outer blank is a generally rectilinear flat panel of material.

12. The method of claim 1 wherein each inner blank and each outer blank is a tubular blank of material and the resulting bag has four sidewalls each formed from two layers of material.

13. The method of claim 1 wherein in step d) the side edges of the outer blanks are connected to the side edges of the inner blanks along substantially their entire length.

14. A method of making a flexible and collapsible bulk bag from a plurality of generally flat blanks comprising the steps of:

a) providing at least a pair of generally flat inner blanks each having at least one pair of opposed side edges and connecting them together along a line generally midway between the pair of opposed side edges of each inner blank;

b) severing each inner blank along the line of connection forming a left half and a right half of gusseted inner blanks with each half comprising a portion of each of the inner blanks with the portions of each inner blank of each half still connected together;

c) providing at least a pair of generally flat outer blanks adjacent the left and right halves of the severed inner blanks with the left and right halves received between the outer blanks, the outer blanks each have a pair of opposed side edges generally aligned with the side edges of the inner blanks;

d) connecting together the side edges of the outer blanks with the adjacent side edges of the gusseted inner blanks;

e) providing a bottom wall interconnecting one end of each of the outer blanks and the left and right halves of the gusseted inner blanks by connecting each outer blank to an adjacent inner blank along canted lines forming triangular portions adjacent an end of each outer blank and an adjacent end of both the left and right halves of the severed inner blanks to provide a generally rectilinear integral bottom wall when the bag is expanded; and f) connecting a reinforcing patch to the bag surrounding the apex of each triangular portion to strengthen the bottom wall.

15. A method of making a plurality of flexible and collapsible gusseted bulk bags from a plurality of flat panels comprising the steps of:

a) providing at least a pair of elongate webs of inner flat panels each having at least one pair of opposed side edges;

b) connecting together each inner flat panel along a line generally parallel to and midway between the pair of opposed side edges of each inner flat panel;

c) severing each inner flat panel along the line of connection forming a left half and a right half of gusseted inner flat panels with each half comprising a portion of each of the inner flat panels with the portions of each inner flat panel of each half still connected together;

d) providing at least a pair of elongate webs of outer flat panels adjacent the left and right halves of the severed inner flat panels with the left and right halves received between the outer flat panels, the outer flat panels each have a pair of opposed side edges generally aligned with the side edges of the inner flat panels;

e) connecting together the side edges of the outer flat panels with the adjacent side edges of the gusseted inner flat panels along substantially their entire length so that the inner blanks define opposed walls of the bag;

f) severing each flat panel from its elongate web providing a discrete blank of the interconnected outer flat panels and gusseted inner flat panels having opposed upper and lower ends; and g) providing a bottom wall adjacent one end of the blank.

16. The method of claim 15 wherein the line of connection between the inner flat panels is formed by heat sealing the inner flat panels together.

17. The method of claim 15 wherein step b) also comprises providing a second line of connection between the inner flat panels, spaced from the other line of connection and extending generally parallel to the other line of connection.

18. The method of claim 17 wherein step c) comprises severing the inner flat panels between the second line of connection and the other line of connection.

19. The method of claim 15 wherein in step a) four inner flat panels are provided and in step d) four outer flat panels are provided with the severed inner flat panels received between opposed pairs of outer flat panels to provide a bag with each sidewall formed from two layers of material.

20. The method of claim 15 wherein in step a) six inner flat panels are provided and in step d) six outer flat panels are provided with the severed inner flat panels received between opposed sets of three layers of outer flat panels to provide a bag with each sidewall formed from three layers of material.

21. The method of claim 15 wherein in step a) eight inner flat panels are provided and in step d) eight outer flat panels are provided with the severed inner flat panels received between opposed sets of four layers of outer flat panels to provide a bag with each sidewall formed from four layers of material.

22. The method of claim 15 wherein each line of connection between the outer flat panels and inner flat panels is formed by heat sealing.

23. The method of claim 15 wherein step g) comprises connecting each outer flat panel to an adjacent inner flat panel along canted lines forming triangular portions adjacent an end of the blank to provide a generally rectilinear, integral bottom wall when the bag is expanded.

24. The method of claim 15 wherein the outer flat panels have a greater width than the left and right halves of the severed inner flat panels when expanded, so that the bag is generally rectangular in cross section when expanded.

25. The method of claim 15 wherein the elongate blanks of the inner flat panels and outer flat panels are provided from wound rolls of material.

26. A method of making a flexible and collapsible bulk bag from a plurality of tubular blanks of material, comprising the steps of:

a) providing at least a pair of generally flat inner tubular blanks each having at least one pair of opposed side edges and connecting them together along a line generally midway between the pair of opposed side edges of each inner tubular blank;

b) severing each inner tubular blank along the line of connection forming a left half and a right half of gusseted inner tubular blanks with each half comprising a portion of each of the inner tubular blanks with the portions of each inner tubular blank of each half still connected together;

c) providing at least a pair of generally flat outer tubular blanks adjacent the left and right halves of the severed inner tubular blanks with the left and right halves received between the outer tubular blanks, the outer tubular blanks each have a pair of opposed side edges generally aligned with the side edges of the inner tubular blanks;

d) connecting together the side edges of the outer tubular blanks with the adjacent side edges of the gusseted inner tubular blanks with the outer tubular blanks defining opposed walls of the bag and the inner tubular blanks defining opposed walls of the bag; and e) providing a bottom wall interconnecting one end of each of the outer tubular blanks and the left and right halves of the gusseted inner tubular blanks.

27. The method of claim 26 wherein in step d) the side edges of the outer tubular blanks are connected to the side edges of the inner tubular blanks along substantially their entire length.

* * * * *